US007695112B2

(12) United States Patent
Raman

(10) Patent No.: US 7,695,112 B2
(45) Date of Patent: Apr. 13, 2010

(54) FLUID EJECTION DEVICE

(75) Inventor: Gopalan Raman, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 210 days.

(21) Appl. No.: 11/897,302

(22) Filed: Aug. 30, 2007

(65) Prior Publication Data

US 2007/0296769 A1 Dec. 27, 2007

Related U.S. Application Data

(62) Division of application No. 10/789,040, filed on Feb. 27, 2004, now Pat. No. 7,281,783.

(51) Int. Cl.
*B41J 2/05* (2006.01)

(52) U.S. Cl. ..... 347/65; 347/56

(58) Field of Classification Search ..... 347/65
See application file for complete search history.

(56) References Cited

U.S. PATENT DOCUMENTS 4,794,411 A 12/1988 Taub et al.
4,853,036 A 8/1989 Koike et al.
5,462,590 A 10/1995 Yui et al.
5,580,372 A 12/1996 Gino et al.
5,608,436 A 3/1997 Baughman et al.
5,666,143 A * 9/1997 Burke et al. ..... 347/65
5,734,399 A 3/1998 Weber et al.
5,757,400 A 5/1998 Hoisington
5,874,974 A 2/1999 Courian et al.
5,912,685 A 6/1999 Raman
5,946,012 A * 8/1999 Courian et al. ..... 347/63
6,145,977 A 11/2000 Natsuhara et al.
6,161,923 A 12/2000 Pidwerbecki et al.
6,247,787 B1 6/2001 Giere et al.
6,247,798 B1 6/2001 Cleland et al.
6,302,505 B1 10/2001 Askeland et al.
6,312,112 B1 11/2001 Pietrzyk
6,341,856 B1 1/2002 Thompson et al.
6,364,467 B1 4/2002 Blair et al.
6,443,564 B1 * 9/2002 Keil et al. ..... 347/65

(Continued)

FOREIGN PATENT DOCUMENTS

EP 0636481 2/1995

(Continued)

OTHER PUBLICATIONS

WO Search Report PCT/US2005/004992, Jun. 2005, Hewlett-Packard.

(Continued)

*Primary Examiner*—Matthew Luu
*Assistant Examiner*—Brian J Goldberg

(57) ABSTRACT

A fluid ejection device includes a chamber, a first fluid channel and a second fluid channel each communicated with the chamber, a first peninsula extended along the first fluid channel and a second peninsula extended along the second fluid channel, and a first sidewall extended between the first peninsula and the chamber, and a second sidewall extended between the second peninsula and the chamber. The first sidewall is oriented at a first angle to the chamber and the second sidewall is oriented at a second angle to the chamber such that the second angle is different from the first angle.

11 Claims, 7 Drawing Sheets

U.S. PATENT DOCUMENTS

| | | | | |
|---|---|---|---|---|
| 6,467,882 | B2 | 10/2002 | Inui et al. | |
| 6,478,418 | B2 | 11/2002 | Reboa et al. | |
| 6,489,084 | B1 * | 12/2002 | Pidwerbecki et al. | 430/320 |
| 6,527,370 | B1 | 3/2003 | Courian et al. | |
| 6,536,878 | B2 | 3/2003 | Kasperchik et al. | |
| 6,557,974 | B1 | 5/2003 | Weber | |
| 6,565,195 | B2 | 5/2003 | Blair | |
| 6,585,352 | B1 | 7/2003 | Torgerson et al. | |
| 6,766,817 | B2 | 7/2004 | da Silva | |
| 6,918,404 | B2 | 7/2005 | da Silva | |
| 7,066,586 | B2 | 6/2006 | da Silva | |
| 2002/0033862 | A1 | 3/2002 | Yoshihira et al. | |
| 2002/0163563 | A1 | 11/2002 | Blair | |
| 2003/0043245 | A1 | 3/2003 | Yamashita et al. | |
| 2003/0184614 | A1 | 10/2003 | Torgerson et al. | |

FOREIGN PATENT DOCUMENTS

| | | |
|---|---|---|
| EP | 0694398 | 1/1996 |

OTHER PUBLICATIONS

Moojin Ink, Moojin Corporation, Jan. 12, 2004: <http://www.moojin.net/products.php? mode= products_detail&goods_name= Advertising_05>, (2 pgs.).

Piezo Printhead Customization, Palo Alto Research Center, Jan. 12, 2004: <http://www.parc.Xerox.com/research/dhl.projects/dropletdispensing/customization.html> (3 pgs.).

Surface Tension Measurement, Softal Electronic, Jan. 12, 2004: <http://www.softal.de/home/en/products/accessories/measurements/> (1 pg.).

UVivid, UV Narrow Web Printing Inks, Sericol, Jan. 12, 2004: <http://www.sericol.co.uk/ProductsatSeericol/piFORweb23_5_00/FlexoFL.pdf/> (5 pgs.).

* cited by examiner

| Parameter | Exemplary (microns) | Range (microns) |
|---|---|---|
| Fluid Channel Width ($W_1 + W_2$) | 38 | 34-42 |
| Fluid Channel Length (L) | 30 | 29-31 |
| Fluid Channel Angle (left) | 45 degrees | 43-46 degrees |
| Fluid Channel Angle (right) | 32 degrees | 30-34 degrees |
| Peninsula Length ($\ell$) | 31 | 29-32 |
| Island Width (w) | 27 | |
| Firing Resistor Length ($\ell_r$) | 28 | |
| Firing Resistor Width ($w_r$) | 16 | |
| Firing Resistor Clearance (c) | 2 | 1-3 |
| Barrier Layer Thickness (T) | 14 | 12-16 |
| Orifice Plate Thickness (t) | 31 | 29-33 |
| Orifice Diameter (d) | 20 | 18-22 |

*Fig. 4*

FLUID EJECTION DEVICE

CROSS-REFERENCE TO RELATED APPLICATIONS

This application is a Divisional of U.S. patent application Ser. No. 10/789,040, filed on Feb. 27, 2004 now U.S. Pat. No. 7,281,783, which is incorporated herein by reference.

BACKGROUND

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

The droplets themselves, as ejected from the printhead, can affect print quality of the printed image. This is because an ejected drop may not always be a single round (spherical) drop. For example, the ejected drop may include a tail which breaks off during ejection and forms smaller drops separated from the main drop. These smaller drops, if sufficiently small and detached from the main drop, may land adjacent to the main drop on the media and cause spray, namely irregularities, change in optical density depending on the direction of printing (e.g., left-to-right vs. right-to-left), loss of contrast, and/or loss of sharpness depending on their size, number, and/or distance from the main drop. This spray, therefore, may degrade print quality.

In addition, drop ejection frequency can also cause spray and edge raggedness. At high frequencies where firing chamber design may be unable to sufficiently replenish the lost volume of an ejected drop, the firing chamber may only partially fill thereby resulting in drops of smaller drop volume. Conversely, the firing chamber may overfill by a small amount after the first and subsequent drop ejection thereby resulting in drops of larger drop volume. As such, depending on the mass of the drop, the shapes of the drops may vary and have unintended trajectories. These unintended trajectories may cause the odd shaped drop to land ahead of the previous drop and cause edge raggedness, or break into smaller drops and cause spray. This again may degrade print quality. Edge raggedness can also be caused by ink wicking on the media which may be a function of the ink properties.

For these and other reasons, a need exists for the present invention.

SUMMARY

One aspect of the present invention provides a fluid ejection device including a chamber, a first fluid channel and a second fluid channel each communicated with the chamber, a first peninsula extended along the first fluid channel and a second peninsula extended along the second fluid channel, and a first sidewall extended between the first peninsula and the chamber, and a second sidewall extended between the second peninsula and the chamber. The first sidewall is oriented at a first angle to the chamber and the second sidewall is oriented at a second angle to the chamber such that the second angle is different from the first angle.

Another aspect of the present invention provides a fluid ejection device including a chamber, a first fluid channel and a second fluid channel each communicated with the chamber, and an island separating the first fluid channel and the second fluid channel. The island is substantially rectangular and has a first chamfered corner along the first fluid channel and a second chamfered corner along the second fluid channel such that the first chamfered corner is oriented at a first angle and the second chamfered corner is oriented at a second angle different from the first angle.

BRIEF DESCRIPTION OF THE DRAWINGS

FIG. 4 is a table outlining one embodiment of exemplary dimensions and exemplary ranges of dimensions for parameters of one embodiment of a fluid ejection device according to the present invention.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
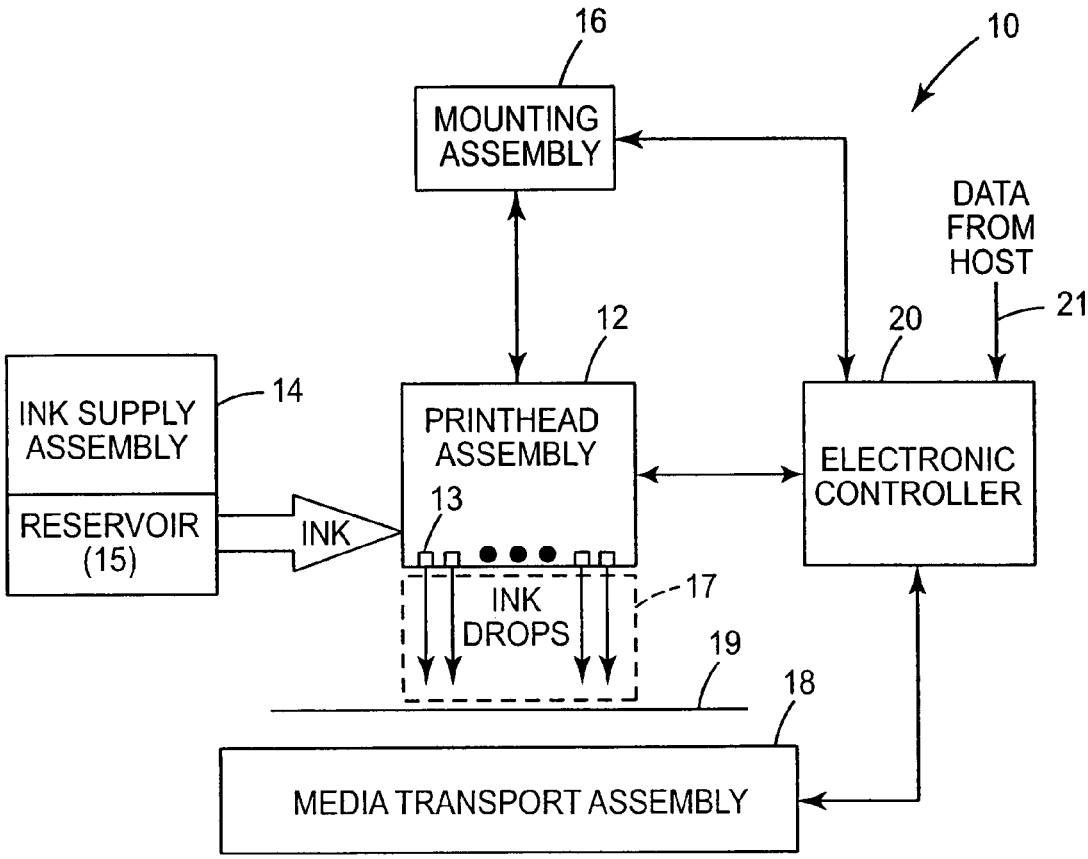
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection device, such as a printhead assembly 12, and a fluid supply, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection device, is formed according to an embodiment of the present invention and ejects drops of ink, including one or more colored inks, through a plurality of orifices or nozzles 13. While the following description refers to the ejection of ink from printhead assembly 12, it is understood that other liquids, fluids, or flowable materials may be ejected from printhead assembly 12.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and print media 19 are moved relative to each other.

Print media 19 includes, for example, paper, card stock, envelopes, labels, transparencies, Mylar, fabric, and the like. In one embodiment, print media 19 is a continuous form or continuous web print media 19. As such, print media 19 may include a continuous roll of unprinted paper.

Ink supply assembly 14, as one embodiment of a fluid supply, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet or fluidjet cartridge or pen. In another embodiment, ink supply assembly 14 is separate from printhead assembly 12 and supplies ink to printhead assembly 12 through an interface connection, such as a supply tube (not shown).

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. print media 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry forming a portion of electronic controller 20 is located off printhead assembly 12.

Figure 2:
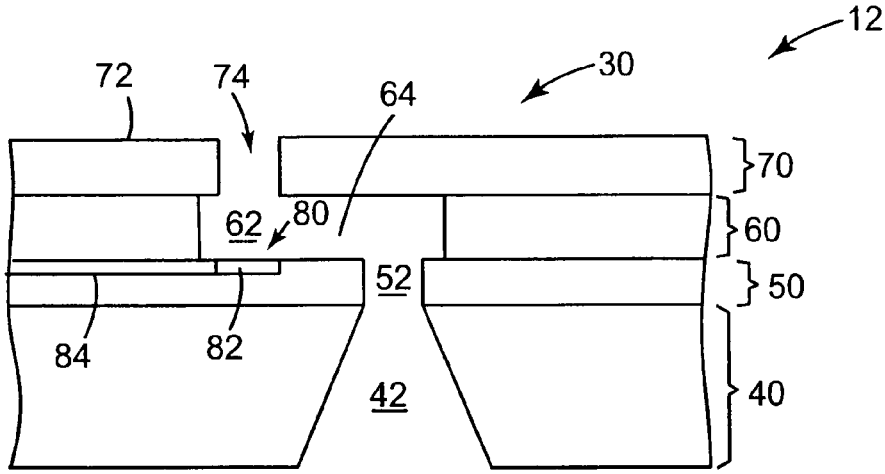
FIG. 2 is a schematic cross-sectional view illustrating one embodiment of a portion of a fluid ejection device according to the present invention.

FIG. 2 illustrates one embodiment of a portion of printhead assembly 12. Printhead assembly 12, as one embodiment of a fluid ejection device, includes an array of drop ejecting elements 30. Drop ejecting elements 30 are formed on a substrate 40 which has a fluid (or ink) feed slot 42 formed therein. As such, fluid feed slot 42 provides a supply of fluid (or ink) to drop ejecting elements 30.

In one embodiment, each drop ejecting element 30 includes a thin-film structure 50, a barrier layer 60, an orifice layer 70, and a drop generator 80. Thin-film structure 50 has a fluid (or ink) feed opening 52 formed therein which communicates with fluid feed slot 42 of substrate 40 and barrier layer 60 has a fluid ejection chamber 62 and one or more fluid channels 64 formed therein such that fluid ejection chamber 62 communicates with fluid feed opening 52 via fluid channels 64.

Orifice layer 70 has a front face 72 and an orifice or nozzle opening 74 formed in front face 72. Orifice layer 70 is extended over barrier layer 60 such that nozzle opening 74 communicates with fluid ejection chamber 62. In one embodiment, drop generator 80 includes a resistor 82. Resistor 82 is positioned within fluid ejection chamber 62 and is electrically coupled by leads 84 to drive signal(s) and ground.

While barrier layer 60 and orifice layer 70 are illustrated as separate layers, in other embodiments, barrier layer 60 and orifice layer 70 may be formed as a single layer of material with fluid ejection chamber 62, fluid channels 64, and/or nozzle opening 74 formed in the single layer. In addition, in one embodiment, portions of fluid ejection chamber 62, fluid channels 64, and/or nozzle opening 74 may be shared between or formed in both barrier layer 60 and orifice layer 70.

In one embodiment, during operation, fluid flows from fluid feed slot 42 to fluid ejection chamber 62 via fluid feed opening 52 and one or more fluid channels 64. Nozzle opening 74 is operatively associated with resistor 82 such that droplets of fluid are ejected from fluid ejection chamber 62 through nozzle opening 74 (e.g., substantially normal to the plane of resistor 82) and toward a print medium upon energization of resistor 82.

Resistor 82 is energized by sending a current thru it. Energy applied to the resistor is controlled by applying a fixed voltage to the resistor for a duration of time. In one embodiment, energy applied to the resistor is represented by the following equation:

$$\text{Energy}=((V*V)*t)/R$$

where V is the voltage applied, R is the resistance of the resistor, and t is the duration of the pulse. Typically, the pulse is a square pulse.

In one embodiment, resistor 82 is connected to a switch which in turn is connected in series to a power supply. In one embodiment, resistor 82 is a split resistor the two legs of which are connected in series. However, other configurations may be utilized. In one exemplary embodiment, the total resistance of the resistor is approximately 125 Ohms.

In one embodiment, the minimum energy for forming a full drop is about 2.5 microjoules. In one embodiment, to ensure stable operation, approximately 25 to 50 percent over-energy is applied to the minimum energy. For example, in this embodiment, for a 15 volt power supply and a 125 Ohms resistor, this translates to approximately 1.7 microseconds for approximately 25 percent over-energy. Other voltages can be applied with corresponding changes in pulse width provided, however, that other electronic components in the circuit can tolerate the voltage without breakdown. In one embodiment, fluid in the firing chamber is preheated to approximately 45 degrees C. to accommodate changes in ambient conditions.

In one embodiment, printhead assembly 12 is a fully integrated thermal inkjet printhead. As such, substrate 40 is formed, for example, of silicon, glass, or a stable polymer, and thin-film structure 50 includes one or more passivation or insulation layers formed, for example, of silicon dioxide, silicon carbide, silicon nitride, tantalum, poly-silicon glass, or other material. Thin-film structure 50 also includes a conductive layer which defines resistor 82 and leads 84. The conductive layer is formed, for example, by aluminum, gold, tantalum, tantalum-aluminum, or other metal or metal alloy. In addition, barrier layer 60 is formed, for example, of a photoimageable epoxy resin, such as SU8 and orifice layer 70 is formed of one or more layers of material including, for example, a metallic material, such as nickel, copper, iron/nickel alloys, palladium, gold, or rhodium. Other materials, however, may be used for barrier layer 60 and/or orifice layer 70.

Figure 3:
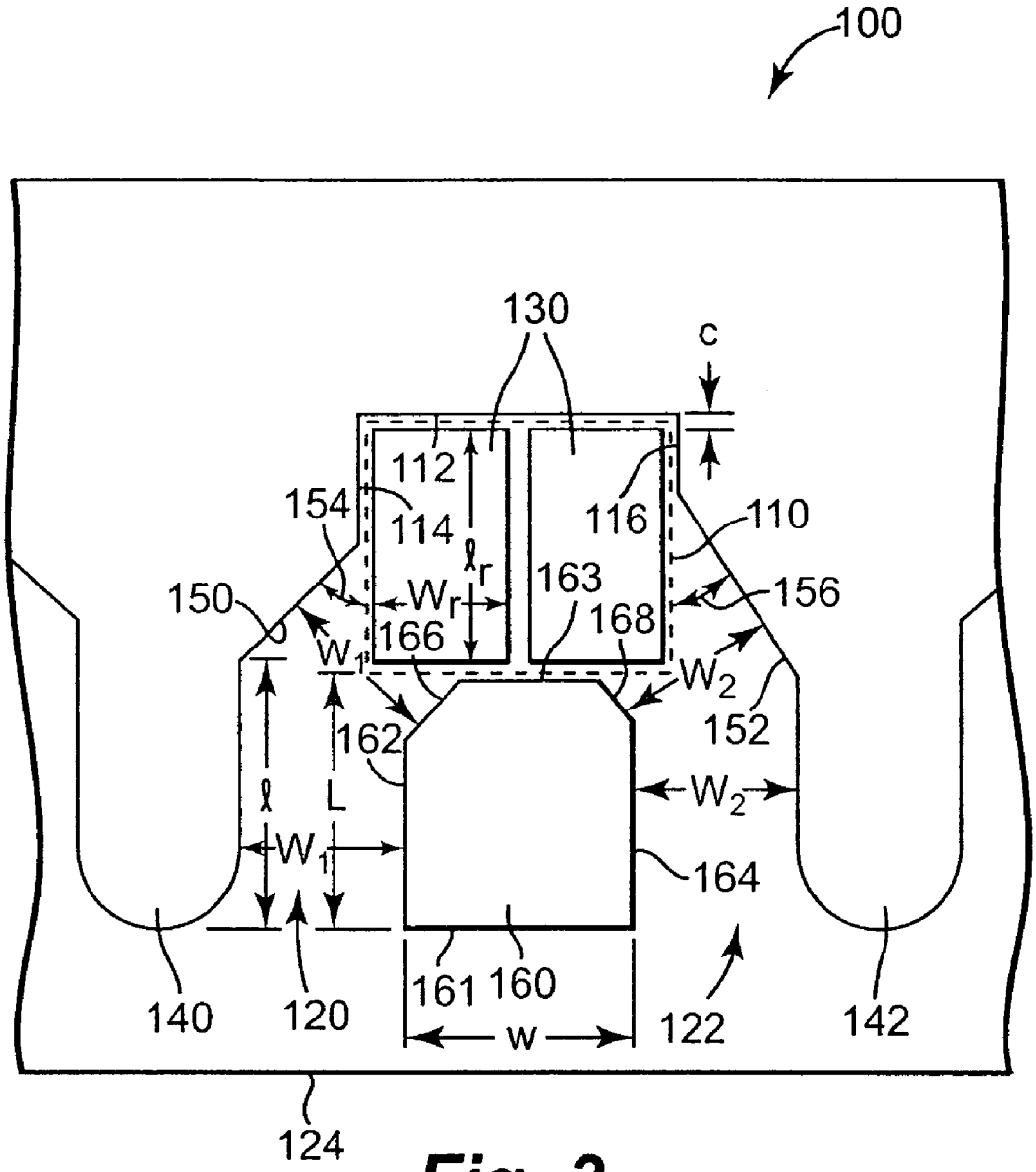
FIG. 3 is a plan view illustrating one embodiment of a portion of a fluid ejection device according to the present invention.

FIG. 3 illustrates one embodiment of a portion of a fluid ejection device, such as printhead 12, with the orifice layer removed. Fluid ejection device 100 includes a fluid ejection chamber 110 and fluid channels 120 and 122. In one embodiment, fluid ejection chamber 110 includes an end wall 112 and opposite sidewalls 114 and 116. As such, the boundaries of fluid ejection chamber 110 are defined generally by end wall 112 and opposite sidewalls 114 and 116. In one embodiment, sidewalls 114 and 116 are oriented substantially parallel to each other.

Fluid channels 120 and 122 communicate with fluid ejection chamber 110 and supply fluid from a fluid feed slot 124 (only one edge of which is shown in the figure) to fluid ejection chamber 110. A resistor 130, as one embodiment of a drop generator, is positioned within fluid ejection chamber 110 such that droplets of fluid are ejected from fluid ejection chamber 110 by activation of resistor 130, as described above. As such, the boundaries of fluid ejection chamber 110 are defined to encompass or surround resistor 130. In one embodiment, resistor 130 includes a split resistor. It is, however, within the scope of the present invention for resistor 130 to include a single resistor or multiple split resistors.

In one embodiment, a peninsula 140 extends along fluid channel 120 and a peninsula 142 extends along fluid channel 122. In addition, a sidewall 150 extends between peninsula 140 and fluid ejection chamber 110, and a sidewall 152 extends between peninsula 142 and fluid ejection chamber 110. Furthermore, in one embodiment, an island 160 separates fluid channels 120 and 122. As such, the boundaries of fluid channel 120 are defined by peninsula 140, sidewall 150, and island 160, and the boundaries of fluid channel 122 are defined by peninsula 142, sidewall 152, and island 160. peninsulas 140 and 142, therefore, extend out into and are surrounded by fluid on three sides whereas island 160 is surrounded by fluid on all sides.

In one embodiment, sidewalls 150 and 152 of respective fluid channels 120 and 122 are each oriented at an angle to fluid ejection chamber 110 and, more specifically, respective sidewalls 114 and 116 of fluid ejection chamber 110. In addition, peninsulas 140 and 142 are each oriented substantially parallel with respective sidewalls 114 and 116 of fluid ejection chamber 110. In one embodiment, sidewall 150 of fluid channel 120 is oriented at an angle 154 to sidewall 114 of fluid ejection chamber 110 and sidewall 152 of fluid channel 122 is oriented at an angle 156 to sidewall 116 of fluid ejection chamber 110. In one embodiment, angle 156 is less than angle 154. As such, with differing angles 154 and 156, fluid channels 120 and 122 communicate with and supply fluid to differing areas of fluid ejection chamber 110 at differing fluid flow rates.

In one embodiment, island 160 is generally rectangular in shape and has sides 161, 162, 163, and 164. In one embodiment, side 161 is oriented substantially parallel with fluid feed slot 124, opposite side 163 is oriented substantially parallel with end wall 112 of fluid ejection chamber 110, side 162 is oriented substantially parallel with peninsula 140, and opposite side 164 is oriented substantially parallel with peninsula 142.

In one embodiment, island 160 has chamfered corners 166 and 168. Chamfered corner 166 is provided between adjacent sides 162 and 163, and chamfered corner 168 is provided between adjacent sides 163 and 164. In one embodiment, chamfered corner 166 is oriented substantially parallel with sidewall 150 of fluid channel 120 and chamfered corner 168 is oriented substantially parallel with sidewall 152 of fluid channel 122. As such, with sidewalls 150 and 152 oriented at different angles 154 and 156, and chamfered corners 166 and 168 oriented substantially parallel with sidewalls 150 and 152, chamfered corners 166 and 168 are oriented at different angles. Thus, in one embodiment, island 160 is asymmetrical.

In one embodiment, as illustrated in FIG. 3 and outlined in the table of FIG. 4, various parameters of fluid ejection device 100 are selected to optimize or improve performance of fluid ejection device 100 such as, for example, reducing spray or improving consistency of drop volume and/or drop shape. For example, a combined width $W_1$ and $W_2$ of respective fluid channels 120 and 122, a length L of fluid channels 120 and 122, as well as angles 154 and 156 of fluid channels 120 and 122 are optimized. In addition, a length l of peninsulas 140 and 142 and a width w of island 160 are also optimized. In one embodiment, as described above, resistor 130 includes a split resistor. As such, a length $l_r$ and a width $w_r$ of each portion of resistor 130 is optimized. In addition, a clearance c between resistor 130 and end wall 112 of fluid ejection chamber 110 is also optimized.

In one embodiment, respective widths $W_1$ and $W_2$ of fluid channels 120 and 122 are measured between respective sides 162 and 164 of island 160 and peninsulas 140 and 142, and measured between respective chamfered corners 166 and 168 of island 160 and sidewalls 150 and 152. As such, widths $W_1$ and $W_2$ represent minimum widths of fluid channels 120 and 122. In one embodiment, widths $W_1$ and $W_2$ of fluid channels 120 and 122 along a portion of respective peninsulas 140 and 142 and along respective sidewalls 150 and 152 are substantially constant. In one embodiment, length L of fluid channels 120 and 122 is measured between fluid ejection chamber 110 and an end of island 160. As such, length L represents a minimum length of fluid channels 120 and 122.

In one embodiment, the fill rate of fluid ejection chamber 110 is directly proportional to the cross-sectional area of the fluid channels presented to the fluid. The cross-sectional area of the fluid channels is defined by the height or depth of the fluid channels and the width of the fluid channels. As such, in one embodiment, the cross-sectional area of the fluid channels is substantially rectangular in shape. The cross-sectional area of the fluid channels, however, may be other shapes.

While respective widths $W_1$ and $W_2$ of fluid channels 120 and 122 are illustrated as being substantially equal to each other, in other embodiments, respective widths $W_1$ and $W_2$ of fluid channels 120 and 122 may vary relative to each other. More specifically, the total cross-sectional area of fluid channels 120 and 122 is optimized such that respective widths $W_1$ and $W_2$ of fluid channels 120 and 122 may vary relative to each other. As such, the combined width ($W_1$+$W_2$) of fluid channels 120 and 122 is optimized. The total impedance to fluid flow through fluid channels 120 and 122, therefore, remains the same.

In one embodiment, the total impedance to fluid flow through fluid channels 120 and 122 to fluid ejection chamber 110 is optimized so as to avoid overfilling of fluid ejection chamber 110. As such, fluid ejection device 100 is optimized so as to maintain a substantially constant impedance to flow of fluid to fluid ejection chamber 110 over a desired operating range. In one exemplary embodiment, fluid ejection device 100 is optimized so as to maintain a substantially constant impedance to flow of fluid to fluid ejection chamber 110 over an operating range of up to at least approximately 18 kilohertz.

In one embodiment, fluid ejection chamber 110 and fluid channels 120 and 122 of fluid ejection device 100 are formed in a barrier layer, such as barrier layer 60 (FIG. 2). As such, peninsulas 140 and 142, sidewalls 150 and 152, and island 160 are formed by the material of the barrier layer. In addition, an orifice layer having an orifice formed therein, such as orifice layer 70 and orifice 74 (FIG. 2), extends over the barrier layer. As such, in one embodiment, as outlined in the table of FIG. 4, a thickness T of the barrier layer, as well as a thickness t of the orifice layer and a diameter d of the orifice of the orifice layer are also optimized. In one embodiment, thickness T of the barrier layer establishes the height or depth of fluid ejection chamber 110 and fluid channels 120 and 122. Thus, by optimizing select parameters of fluid ejection device 100, as described above, the volume and/or rate of fluid supplied to fluid ejection chamber 110 can be optimized.

Figure 5:
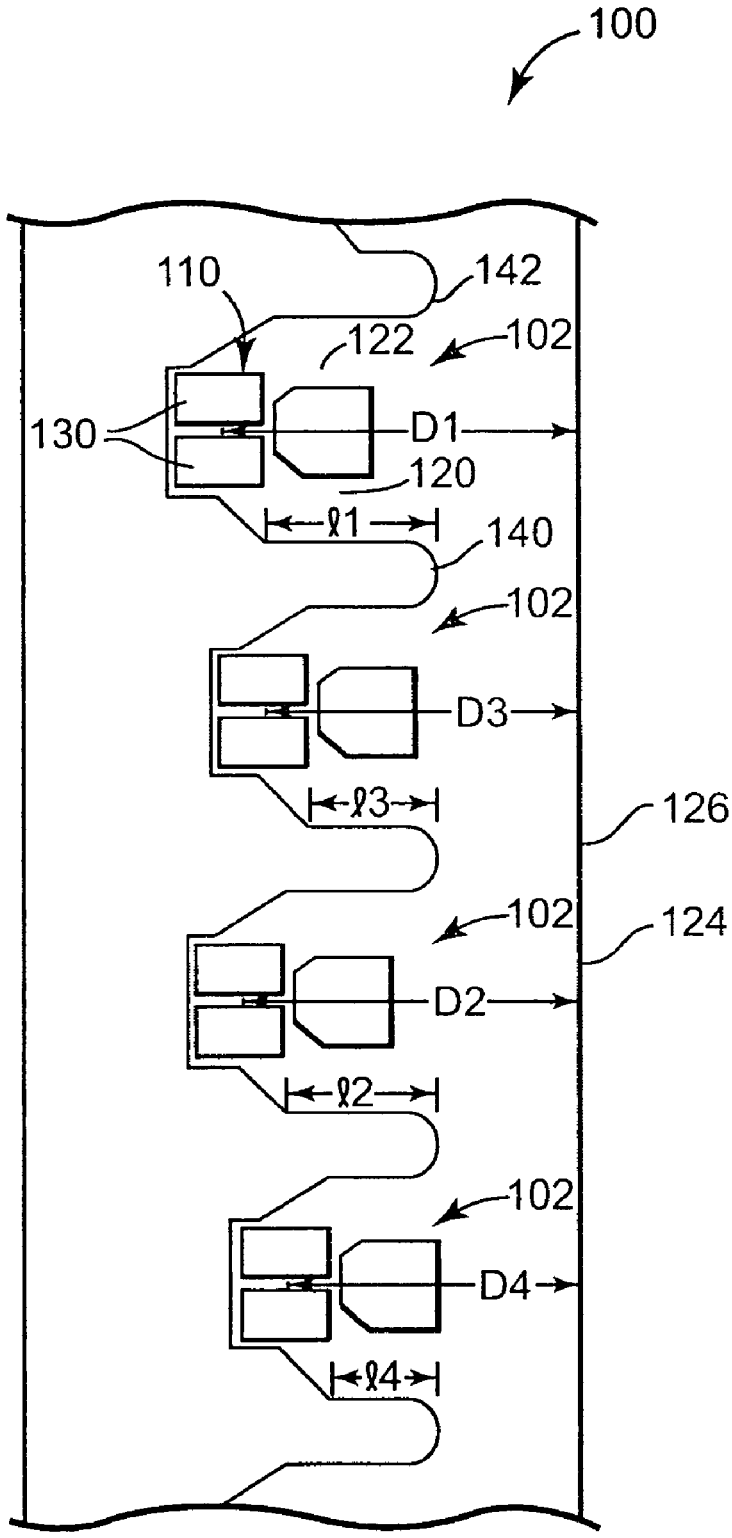
FIG. 5 is a plan view illustrating one embodiment of a fluid ejection device including a plurality of drop ejecting elements according to the present invention.

In one embodiment, as illustrated in FIG. 5, fluid ejection device 100 includes a plurality of drop ejecting elements 102. Each drop ejecting element 102 includes a respective fluid ejection chamber 110, resistor 130, and fluid channels 120 and 122. In one embodiment, drop ejecting elements 102 are arranged to substantially form a column of drop ejecting elements.

In one embodiment, drop ejecting elements 102 are staggered relative to each other within a respective column. More specifically, a distance between respective fluid ejection chambers 110 and an edge 126 of fluid feed slot 124 varies within the column of drop ejecting elements 102. For example, fluid ejection chamber 110 of one drop ejecting element 102 is spaced a distance D1 from edge 126, fluid ejection chamber 110 of another drop ejecting element 102 is spaced a distance D2 from edge 126, fluid ejection chamber 110 of another drop ejecting element 102 is spaced a distance D3 from edge 126, and fluid ejection chamber 110 of another drop ejecting element 102 is spaced a distance D4 from edge 126. In one embodiment, distance D1 is greater than distance D2, distance D2 is greater than distance D3, and distance D3 is greater than distance D4. As such, drop ejecting elements 102 are spaced varying distances from fluid feed slot 124.

In one embodiment, as illustrated in FIG. 5, the ends of peninsulas 140 and 142 of the plurality of drop ejecting elements 102 are substantially aligned. As such, a distance between peninsulas 140 and 142 and edge 126 of fluid feed slot 124 for drop ejecting elements 102 is substantially constant. Thus, to accommodate the staggered arrangement of drop ejecting elements 102 relative to edge 126 and the alignment of peninsulas 140 and 142 with edge 126, a length of the respective peninsulas 140 and 142 of each of the plurality of drop ejecting elements 102 is varied.

For example, in one embodiment, peninsulas 140 and 142 of one drop ejecting element 102 have a length l1, peninsulas 140 and 142 of another drop ejecting element 102 have a length l2, peninsulas 140 and 142 of another drop ejecting element 102 have a length l3, and peninsulas 140 and 142 of another drop ejecting element 102 have a length l4. In one embodiment, length l1 is greater than length l2, length l2 is greater than length l3, and length l3 is greater than length l4. In one exemplary embodiment, the length of peninsulas 140 and 142 for drop ejecting elements 102 is in a range of approximately 30 microns to approximately 52 microns. By aligning peninsulas 140 and 142 of drop ejecting elements 102 with edge 126 of fluid feed slot 124, cross-talk between adjacent fluid ejection chambers 102 can be reduced.

Figure 6:
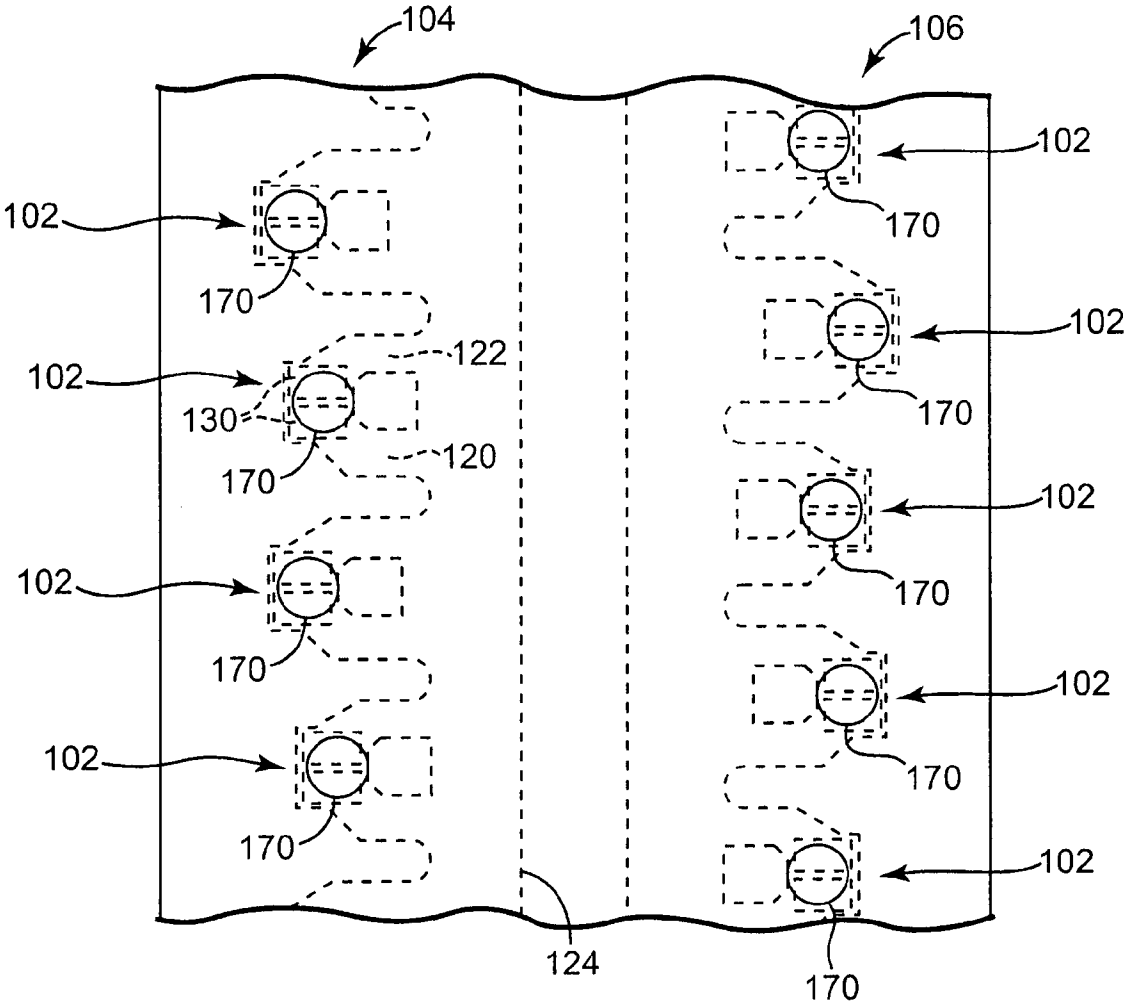
FIG. 6 is a plan view illustrating one embodiment of a fluid ejection device including two columns of drop ejecting elements according to the present invention.

As illustrated in the embodiment of FIG. 6, two columns 104 and 106 of drop ejecting elements 102 are arranged on opposite sides of fluid feed slot 124. In addition to a respective fluid ejection chamber 110, resistor 130, and fluid channels 120 and 122, each drop ejecting element 102 also includes a respective orifice 170 communicated with the respective fluid ejection chamber 110. In one embodiment, columns 104 and 106 are staggered relative to each other (e.g., vertically with respect to the figure) such that the center of a fluid ejection chamber of a respective drop ejecting element 102 of column 104, for example, is positioned substantially between the centers of two fluid ejection chambers of respective drop ejecting elements 102 of column 106. It is understood that the relative proportions of the width of fluid feed slot 124 and spacing between columns 104 and 106 of drop ejecting elements 102 in FIG. 6 is for illustrative purposes only.

In one embodiment, orifices 170 of drop ejecting elements 102 are offset relative to a center of the respective fluid ejection chamber 110. More specifically, in one embodiment, orifices 170 are offset toward or away from fluid feed slot 124. For example, as illustrated in the embodiment of FIG. 6, orifices 170 of respective drop ejecting elements 102 of column 104 and orifices 170 of respective drop ejecting elements 102 of column 106 are each offset toward fluid feed slot 124. In one exemplary embodiment, a center of orifices 170 are offset relative to a center of the respective fluid ejection chamber 110 by a distance of approximately +/−2 microns.

In one embodiment, in addition to optimizing parameters of fluid ejection device 100, as described above, properties of the fluid ejected from fluid ejection device 100 are also optimized to optimize performance of fluid ejection device 100. In one embodiment, for example, surface tension, viscosity, and/or pH of the fluid ejected from fluid ejection device 100 is optimized to optimize performance of fluid ejection device 100, including optimizing a drop weight of droplets ejected from fluid ejection device 100 and a frequency response of fluid ejection device 100. In one exemplary embodiment, surface tension of the fluid ejected from fluid ejection device 100 is in a range of approximately 42 dynes/centimeter to approximately 48 dynes/centimeter, viscosity of the fluid ejected from fluid ejection device 100 is in a range of approximately 2.2 centipoises to approximately 3.2 centipoises, and pH of the fluid ejected from fluid ejection device 100 is in a range of approximately 7.8 to approximately 8.4, wherein surface tension, viscosity, and pH are measured at approximately 25 degrees C.

In one embodiment, fluid ejection device 100 is optimized to produce droplets of substantially uniform or constant drop weight. In one exemplary embodiment, a drop weight of droplets ejected from fluid ejection device 100 is in a range of approximately 10 nanograms to approximately 16 nanograms. In one exemplary embodiment, a drop weight of droplets ejected from fluid ejection device 100 is approximately 15 nanograms. In addition, in one embodiment, a frequency at which droplets of fluid are ejected from fluid ejection device 100 is also optimized to optimize performance of fluid ejection device 100.

Figure 7:
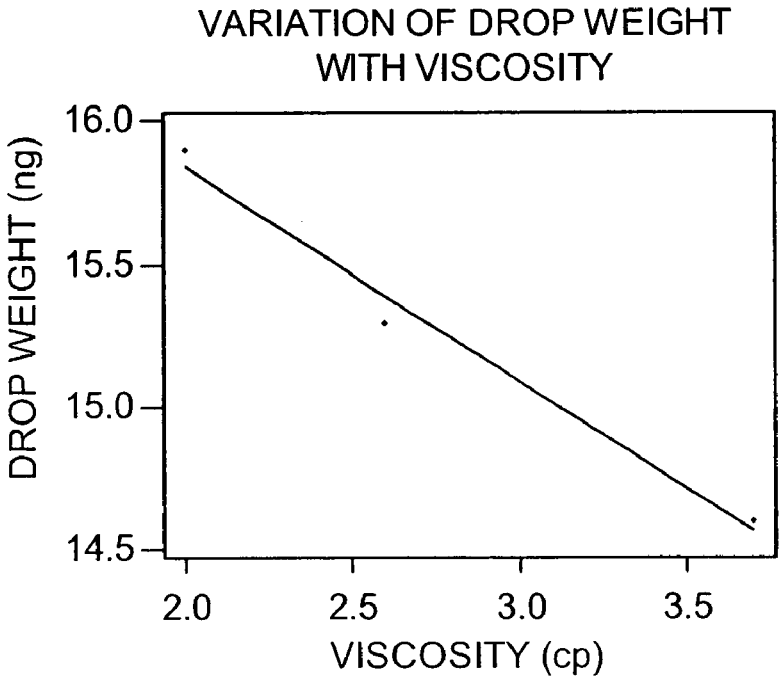
FIG. 7 is a graph illustrating one embodiment of drop weight versus fluid viscosity for a drop ejected from a fluid ejection device according to the present invention.

In one embodiment, as illustrated in the graph of FIG. 7, drop weight of droplets ejected from fluid ejection device 100 varies with viscosity of the fluid. In one embodiment, drop weight is a linear function of viscosity. As such, in one exemplary embodiment, the relationship of drop weight to viscosity for viscosities in a range of approximately 2 centipoises to approximately 4 centipoises is represented by the following equation:

$$\text{Drop Weight (ng)}=17.3-0.75^{*}\ \text{Viscosity(cp)}$$

Thus, drop weight is inversely proportional to viscosity such that as a viscosity of the fluid increases, a drop weight of droplets ejected from fluid ejection device 100 decreases.

Figure 8:
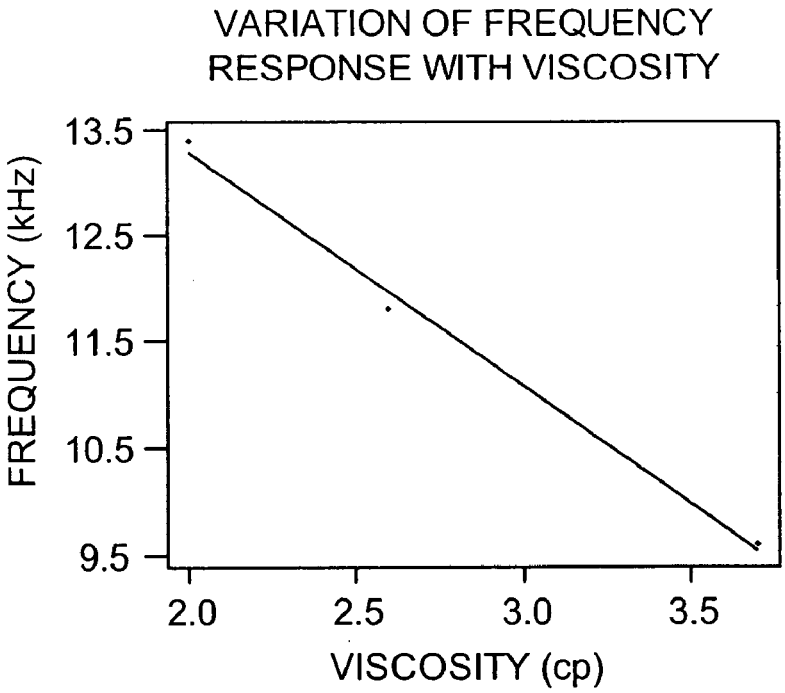
FIG. 8 is a graph illustrating one embodiment of frequency of drop ejection versus fluid viscosity for a drop ejected from a fluid ejection device according to the present invention.

In one embodiment, as illustrated in the graph of FIG. 8, frequency response of operation of fluid ejection device 100 varies with viscosity of the fluid. In one embodiment, frequency response is a linear function of viscosity. As such, in one exemplary embodiment, the relationship of frequency response to viscosity for viscosities in a range of approximately 2 centipoises to approximately 4 centipoises is represented by the following equation:

$$\text{Frequency (kHz)}=17.7-2.2^{*}\ \text{Viscosity(cp)}$$

Thus, frequency response is inversely proportional to viscosity such that as a viscosity of the fluid increases, a frequency at which droplets of the fluid can be ejected from fluid ejection device 100 decreases. In one embodiment, the frequency response represented by the above equation represents the highest frequency at which the drop weight of droplets ejected from fluid ejection device 100 remains substantially constant.

Figure 9:
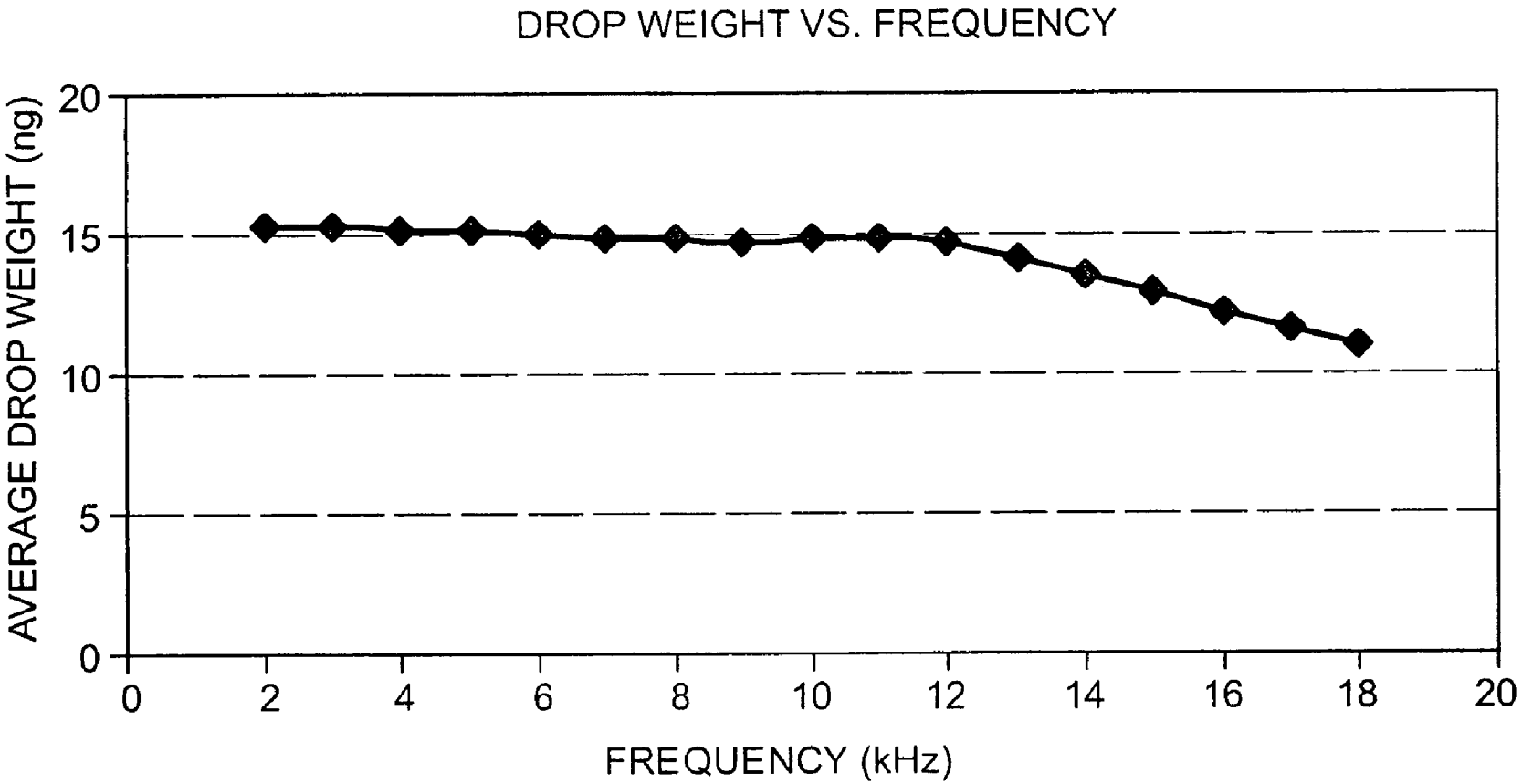
FIG. 9 is a graph illustrating one embodiment of drop weight versus frequency of drop ejection for a drop ejected from a fluid ejection device according to the present invention.

In one embodiment, as illustrated in the graph of FIG. 9, drop weight of droplets ejected from fluid ejection device 100 is plotted against frequency of operation of fluid ejection device 100. In one embodiment, fluid ejection device 100, including the fluid ejected by fluid ejection device 100, is optimized so as to eject droplets of fluid having a substantially uniform drop weight over a relatively wide operating range. In one embodiment, for example, the geometry of fluid ejection device 100 is tuned such that the drop weight of the drops is in a range of approximately 70 percent to approximately 100 percent of the steady state drop weight.

In one exemplary embodiment, fluid ejection device 100 ejects drops of fluid each having a weight in a range of approximately 13 nanograms to approximately 16 nanograms at frequencies up to at least approximately 13 kilohertz. In one exemplary embodiment, fluid ejection device 100 ejects drops of fluid each having a weight in a range of approximately 10 nanograms to approximately 16 nanograms at frequencies up to at least approximately 18 kilohertz. As such, in one exemplary embodiment, with a steady state drop weight of approximately 15 nanograms, fluid ejection device 100 ejects drops having a drop weight in a range of approximately 10.5 nanograms (i.e., 70 percent) to approximately 15 nanograms (i.e., 100 percent) at frequencies up to at least approximately 18 kilohertz.

As such, in an embodiment where fluid ejection device 100 is operated to print at a frequency of 18 kilohertz or 18,000 dots per second, fluid ejection device 100 can produce an image having a resolution of 600 dots per inch (dpi) when fluid ejection device 100 is translated at a speed of 30 inches per second (ips) (600 dots per inch×30 inch per second=18,000 dots/second). Thus, fluid ejection device 100 can produce a high quality image with a substantially constant drop size when operated over a relatively wide frequency range. In addition, in another embodiment where fluid ejection device 100 is operated to print at a frequency of 18 kilohertz or 18,000 dots per second, fluid ejection device 100 can produce an image having a resolution of 300 dots per inch (dpi) when fluid ejection device 100 is translated at a speed of 60 inches per second (ips) (300 dots per inch×60 inch per second=18,000 dots/second). As such, fluid ejection device 100 can operate in a draft mode at a higher print or throughput speed with a substantially constant drop size when operated over a relatively wide frequency range. In other embodiments, additional modes of varying resolution are possible as long as the desired resolution (i.e., dpi) times the translation speed (i.e., ips) is 18,000 dots/second. Furthermore, in other embodiments, fluid ejection device 100 may be operated for single pass or multi-pass printing at different frequencies.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection device, comprising:

a substrate;

a barrier layer formed on the substrate; and an orifice layer extended over the barrier layer, wherein the barrier layer includes a chamber and first and second fluid channels each communicated with the chamber, wherein the first and second fluid channels each have a first portion and a second portion, and wherein a width of the first portion of the first fluid channel is substantially constant and a width of the first portion of the second fluid channel is substantially constant, wherein the barrier layer has a thickness in a range of approximately 12 microns to approximately 16 microns, wherein the first and second fluid channels have a combined minimum width in a range of approximately 34 microns to approximately 42 microns and each have a minimum length in a range of approximately 29 microns to approximately 31 microns, and wherein the second portion of the first fluid channel is oriented at an angle to the chamber in a range of approximately 43 degrees to approximately 46 degrees and the second portion of the second fluid channel is oriented at an angle to the chamber in a range of approximately 30 degrees to approximately 34 degrees.

2. The fluid ejection device of claim 1, wherein the orifice layer has an orifice communicated with the chamber of the barrier layer formed therein, wherein a center of the orifice is offset relative to a center of the chamber.

3. The fluid ejection device of claim 2, wherein the substrate has a fluid opening formed therethrough, and wherein the orifice is offset one of toward and away from the fluid opening of the substrate.

4. The fluid ejection device of claim 2, wherein the orifice has a diameter in a range of approximately 18 microns to approximately 22 microns.

5. The fluid ejection device of claim 1, further comprising:

a supply of fluid communicated with the first fluid channel and the second fluid channel.

6. The fluid ejection device of claim 5, wherein the fluid has a surface tension in a range of approximately 42 dynes/centimeter to approximately 48 dynes/centimeter, and a viscosity in a range of approximately 2.2 centipoises to approximately 3.2 centipoises.

7. The fluid ejection device of claim 5, wherein the device is adapted to eject drops of the fluid at a frequency up to at least approximately 13 kilohertz with each of the drops having a weight in a range of approximately 13 nano grams to approximately 16 nanograms.

8. The fluid ejection device of claim 5, wherein the device is adapted to eject drops of the fluid at a frequency up to at least approximately 18 kilohertz with each of the drops having a weight in a range of approximately 10 nano grams to approximately 16 nanograms.

9. The fluid ejection device of claim 1, wherein a width of the second portion of the first fluid channel is substantially constant and a width of the second portion of the second fluid channel is substantially constant.

10. The fluid ejection device of claim 1, further comprising:

an island separating the first and second fluid channels, wherein the island has a first side and a second side, and the first portion of the first fluid channel extends along the first side of the island and the first portion of the second fluid channel extends along the second side of the island.

11. The fluid ejection device of claim 10, wherein the island further has a first chamfered corner and a second chamfered corner, and the second portion of the first fluid channel extends along the first chamfered corner of the island and the second portion of the second fluid channel extends along the second chamfered corner of the island.

* * * * *

UNITED STATES PATENT AND TRADEMARK OFFICE

CERTIFICATE OF CORRECTION

PATENT NO. : 7,695,112 B2
APPLICATION NO. : 11/897302
DATED : April 13, 2010
INVENTOR(S) : Gopalan Raman It is certified that error appears in the above-identified patent and that said Letters Patent is hereby corrected as shown below:

In column 11, line 15, in Claim 7, delete "nano grams" and insert -- nanograms --, therefor.

In column 11, line 20, in Claim 8, delete "nano grams" and insert -- nanograms --, therefor.

Signed and Sealed this

Twenty-eighth Day of September, 2010

David J. Kappos

David J. Kappos
*Director of the United States Patent and Trademark Office*